United States Patent [19]

Sklenak et al.

[11] Patent Number: 5,034,861

[45] Date of Patent: Jul. 23, 1991

[54] SHELF TRACK LIGHTING

[75] Inventors: John S. Sklenak, Sudbury; Joseph C. Maiellano, Jr., Chelmsford; Sol Aisenberg, Natick, all of Mass.

[73] Assignee: Raytheon Company, Lexington, Mass.

[21] Appl. No.: 455,121

[22] Filed: Dec. 22, 1989

[51] Int. Cl.[5] ..... F25D 27/00

[52] U.S. Cl. ..... 362/92; 362/133; 312/236

[58] Field of Search ..... 362/92, 94, 125, 133, 362/285, 250; 312/223, 236

[56] References Cited

U.S. PATENT DOCUMENTS

| | | | |
|---|---|---|---|
| 2,156,443 | 5/1939 | Zook | 362/94 |
| 2,156,463 | 5/1939 | Schulte | 362/94 |
| 3,506,325 | 4/1970 | Horvay | 312/223 |
| 3,584,927 | 6/1971 | Ott et al. | 312/223 |
| 3,598,464 | 8/1971 | Moroziuk | 312/223 |
| 4,154,492 | 5/1979 | Dunning | 312/223 |
| 4,597,035 | 6/1986 | Lettenmeyer | 362/219 |
| 4,689,726 | 8/1987 | Kretzschmar | 312/223 |

FOREIGN PATENT DOCUMENTS

| | | | |
|---|---|---|---|
| 2368856 | 5/1978 | France | 312/236 |
| 599501 | 5/1978 | Switzerland | 362/125 |

*Primary Examiner*—Ira S. Lazarus
*Assistant Examiner*—Richard E. Cole
*Attorney, Agent, or Firm*—William R. Clark; Richard M. Sharkansky

[57] ABSTRACT

A shelf track lighting for improving illumination of devices such as refrigerators or freezers. Coupled to the shelf is a lamp and a supporting brackets. The brackets engage with vertically positioned standards which are mounted to the rear wall of the device. Power is provided to the lamp through the standards and the brackets so that the lamp may be illuminated when the shelf and lamp levels are adjusted.

14 Claims, 5 Drawing Sheets

SHELF TRACK LIGHTING

BACKGROUND OF THE INVENTION

This invention relates to an apparatus for improving shelf lighting and more particularly, to improving illumination below adjustable shelves in refrigerators, freezer, book shelf systems, storage shelf systems, and the like.

As known, refrigerators are commonly constructed with one or two lights mounted to its back wall for illumination. Refrigerators are also constructed with movable shelves that may be adapted to having the distance between adjacent shelves changed to accommodate different food heights. When a shelf is moved, the moved shelf may block light from the back wall causing shade spots in the refrigerator. Further, when food is placed on the shelves, the food may interfere with the light passing through the shelf, also resulting in shade spots.

SUMMARY OF THE INVENTION

An object of this invention is to provide an improved method of lighting.

Another object of this invention is to provide lighting that illuminates the area under an adjustable shelf when the shelf level is changed.

A further object of this invention is to provide movable shelf illumination to improve the refrigerator's lighting.

It is also an object of this invention to provide configuration lighting using low-voltage power.

An additional object of this invention is to provide improved lighting within a refrigerator by defracting the light with a groove formed within a shelf.

Also an object of this invention is to provide a movable light fixture that contains a lamp that is easy to replace.

Another object of this invention is to provide electrical power to lights on a movable shelf without requiring wiring that has to move with the shelf to deliver power to the lights on the shelf at the new location.

These and other objects are accomplished by an apparatus for lighting a compartment comprising a shelf disposed within the compartment, and means coupled to the shelf for illuminating the area adjacent the shelf. Also included is a means for supporting the shelf in a horizontal position, the supporting means being adapted to adjust the level of shelf and the level of illuminating means, and means for providing power to the illuminating means through the supporting means to allow power to the illuminating means regardless of the shelf level. It may be preferable that the supporting means further comprise means for conducting current to said illuminating means. It may be preferable that the illuminating means comprise a lamp generating light, the lamp being disposed adjacent the shelf, and wherein the shelf has a groove formed within the shelf so as to defract light from the lamp to the area adjacent the shelf to provide better lighting to the region below the shelf.

Alternately, an apparatus is provided for lighting a refrigerator having a plurality of vertical walls, a shelf disposed within the refrigerator, and means coupled to one of the walls for supporting the shelf in a horizontal position, the supporting means being adapted to adjust the vertical level of the shelf. Further provided is means coupled to the shelf for illuminating the refrigerator, wherein the vertical level of the illuminating means changes with the shelf vertical level. It may also be preferable that the bracket engage with the standard, and wherein power is distributed to the illuminating means when the bracket engages with the standard to provide distribution of power to the lamp without requiring any extraneous wires. It may further be preferable that the power providing means comprise an electrically conductive strip coupled to the shelf for electrically connecting the lamp to the bracket to provide power to the lamp through the shelf. It may also be preferable that the illuminating means comprises a lamp coupled below the shelf and means coupled to the brackets for distributing power to the lamp. It may further be preferable that the power distributing means includes a spring electrically coupling said lamp and said brackets so that the lamp may be easily removed from the shelf for replacement.

DESCRIPTION OF THE PREFERRED EMBODIMENTS

Figure 1:
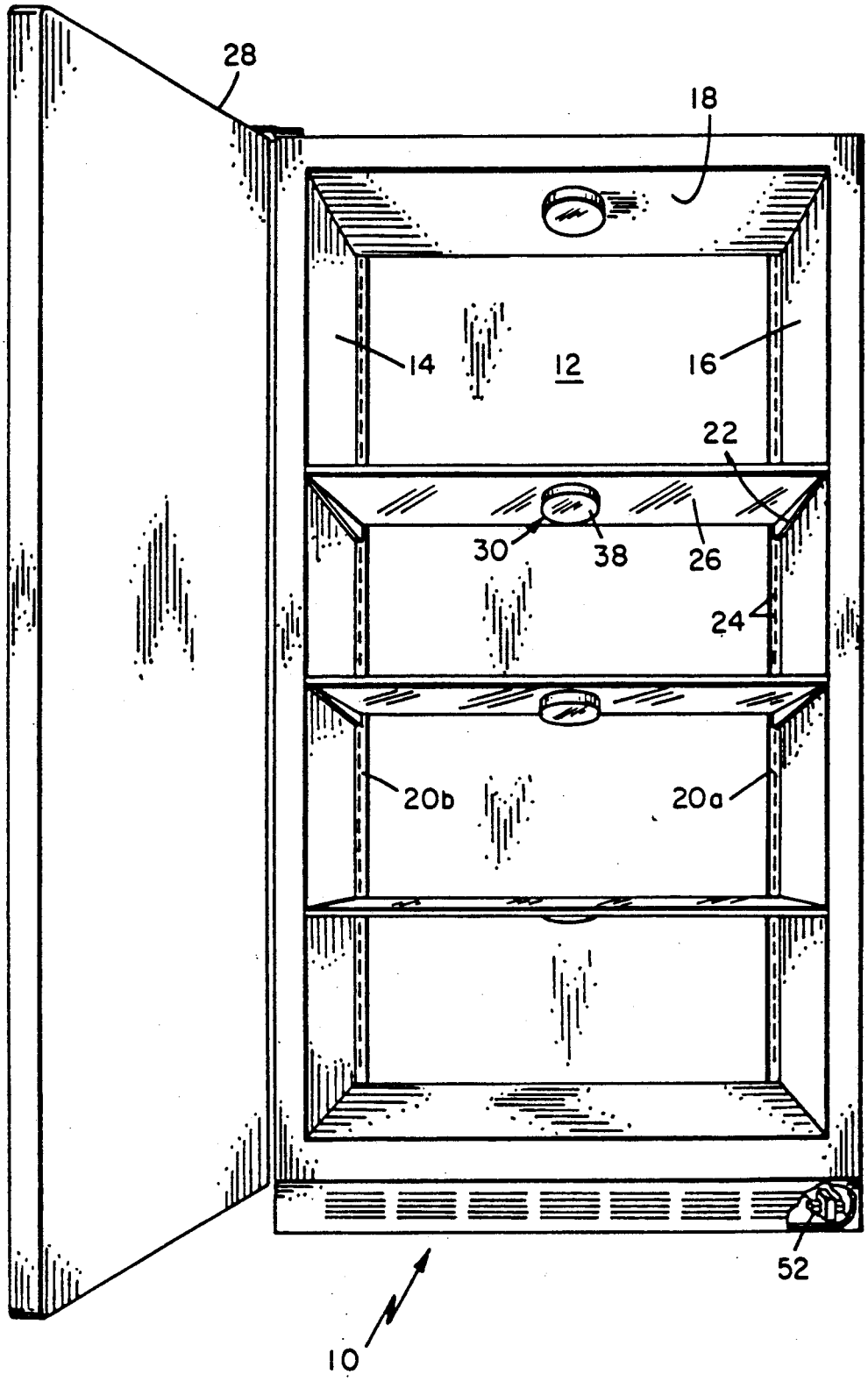
FIG. 1 shows a plan view of an open refrigerator illustrating the invention having lights mounted to the adjustable shelf bottom surface.

Referring to FIG. 1, there is shown a refrigerator 10 having a rear wall 12, a left wall 14, a right wall 16, a door 28, and a ceiling 18. Mounted vertically on rear wall 12 are standards **20*a* and 20*b*, referred to collectively as standards 20**.

Figure 2:
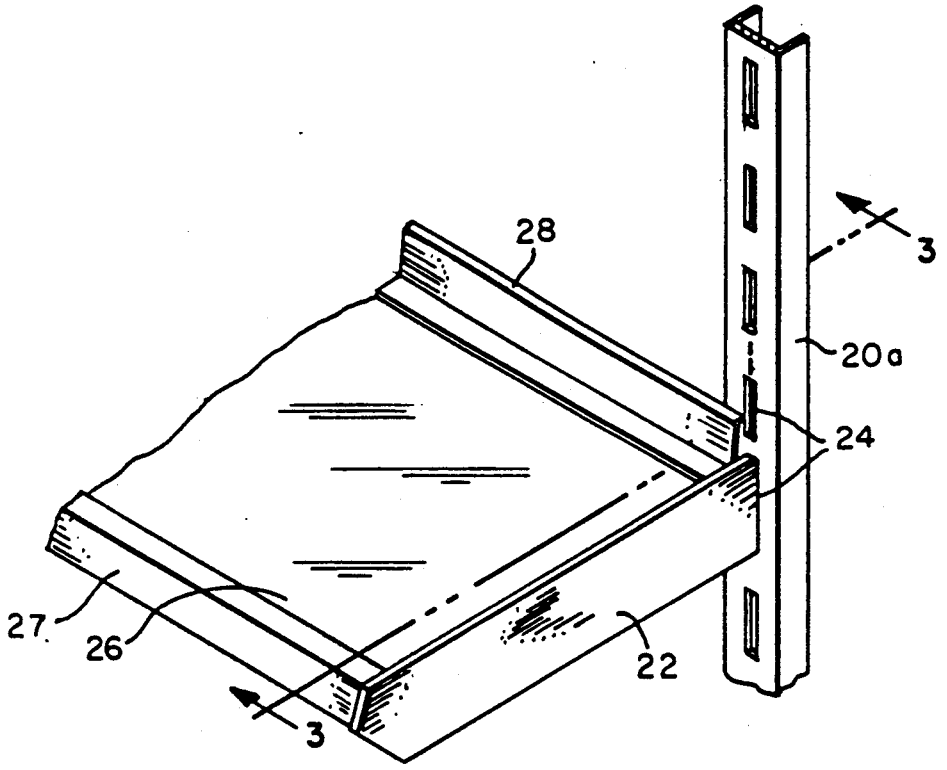
FIG. 2 shows a plan view of the shelf engaging with a standard.
Figure 3:
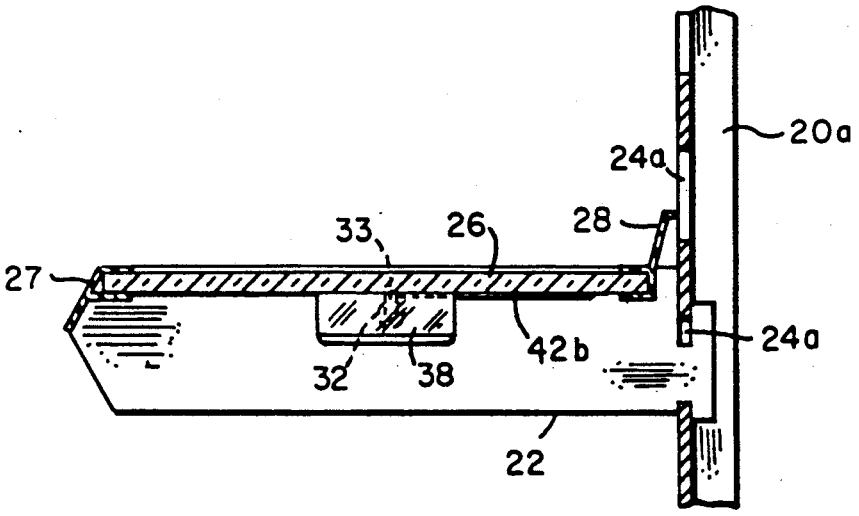
FIG. 3 shows a side view of the connection between the shelf and the standard along the lines of 3—3 of FIG. 1.

Referring to FIGS. 1 through 3, there is shown bracket 22 engaging with standard 20 through slit 24. Supported by bracket 22 is shelf 26. Bracket 22 and standards 20 preferably are constructed from a conductive material. It may also be preferable that bracket 22 and standard 20 be coated with insulation material to prevent accidental shorting or electrical shock if touched.

Shelf 26 front edge is coupled to a groove (not shown) in plastic strip 27. Shelf 26 rear edge is coupled to a groove in plastic strip 28. Plastic strips 27 and 28 edges engage with brackets 22. Plastic strips 27 and 28 and brackets 22 provide support and provide a handle for easy removal of shelf 26 from refrigerator 10. Shelf 26 may be integrally connected to bracket 22, plastic strips 27 and 28. Alternately, shelf 26 may be removably supported by bracket 22 and plastic strips 27 and 28. Shelf 26 is preferably constructed from a light transparent material such as glass.

Figure 4:
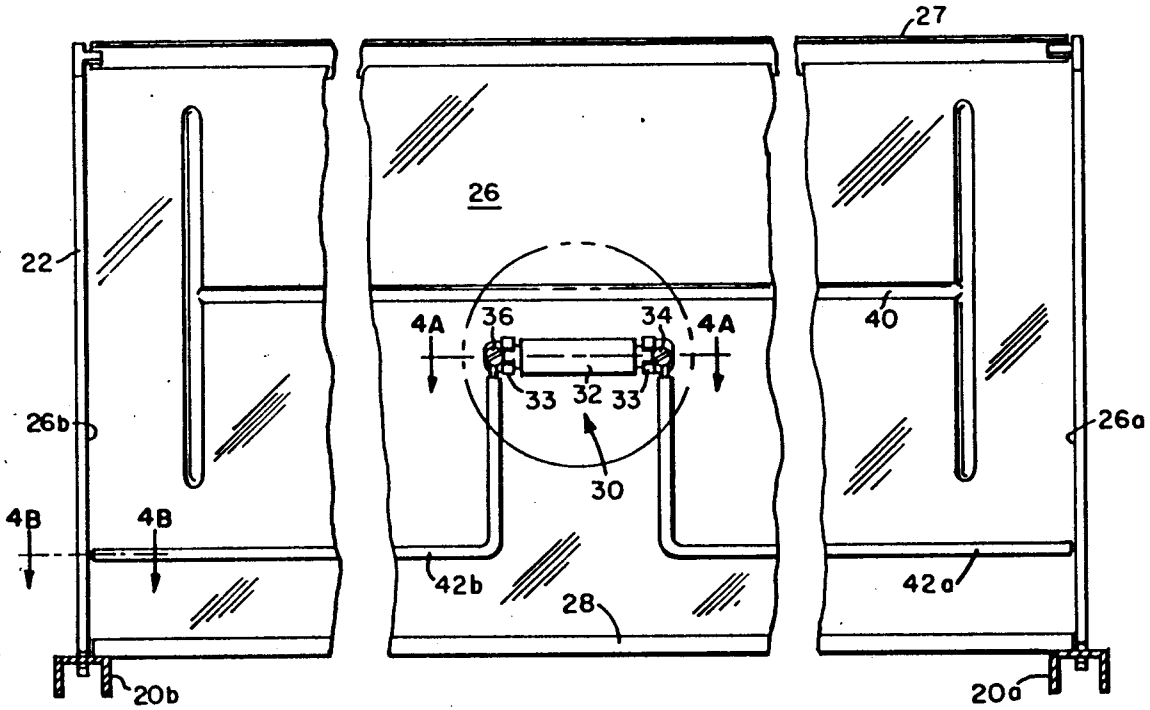
FIG. 4 shows a bottom view of the shelf having a lamp attached thereto and the shelf being attached to a standard with a bracket.
Figure 4A:
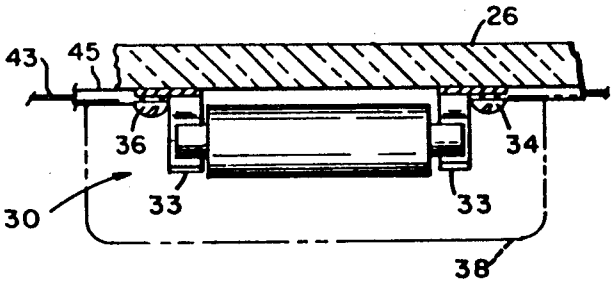
FIG. 4A shows a side view of the lamp mounted on the shelf cut along lines 4A—4A of FIG. 4.

Referring to FIGS. 1, 4, and 4A, there is shown illuminating means 30 mounted below shelf 26. Illuminating means 30 is shown mounted below the center of shelf 26; however; illuminating means 30 may easily be adapted to be mounted above shelf 26 or adjacent the shelf's 26 edges. Referring to FIGS. 4 and 4A, illuminating means 30 preferably includes a low-voltage incandescent lamp 32 that is held in place with holders 33. Holders 33 are held in place on shelf 26 with screws 34 and 36. Preferably, illuminating means 30 has a cover 38 that is attached to shelf 26. Cover 30 protects lamp 32 from any dust or food particles within refrigerator 10.

Referring to FIG. 4, disposed on the surface of shelf 26 is groove 40, and electrically conductive strip 42*a* and 42*b*. Groove 40 is cut into the bottom surface of shelf 26. When lamp 32 illuminates, light is directed upwardly and downwardly from shelf 26. Further, light illuminates through shelf 26 toward the edges 26*a* and 26*b*. Groove 40 defracts light within shelf 26 and directs that light downwardly to better illuminate the shelf below.

Figure 4B:
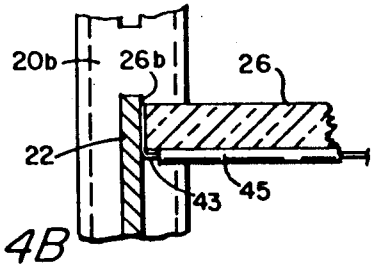
FIG. 4B shows a side view of the connection between a shelf and a standard cut along lines 4B—4B of FIG. 4.

Power is applied through electrically conductive strip 42*a* and 42*b* to lamp 32. Strips 42*a* and 42*b* are preferably constructed from either conductive tape or a metal etch 43 coated with an insulation material 45. Strip 42 is preferably disposed on the bottom of shelf 26. Alternately, conductive strips 42*a* and 42*b* may be diposed on the top of shelf 26 or may be sandwiched in the middle of shelf 26. Conductive 42*a* and 42*b* are electrically connected to screws 33 and 34, and holder 33. Strips 42*a* and 42*b* extend from screws 36 and 34, respectively, toward the left side edge 26*a* and the right side edge 26*b* of shelf 26. As illustrated in FIG. 4B, metal etch 43 separates from insulation layer and extends upwardly along edge 26*b*. Bracket 22 and shelf 26 sandwich metal etch 43 so that metal etch 43 makes electrical contact with bracket 22.

Figure 5:
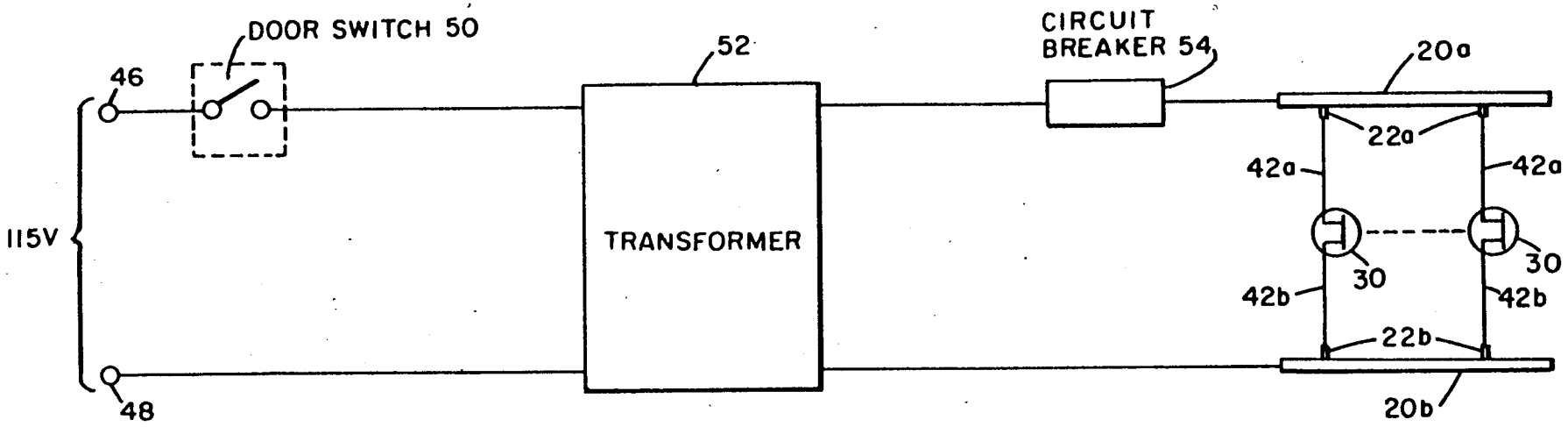
FIG. 5 shows an electrical schematic diagram of the invention.

Referring to FIG. 5, there is shown a schematic diagram of the invention. 115 V alternating current is applied across terminals 46 and 48 that are preferably disposed within the bottom of refrigerator 10. The 115 V alternating current (AC) is then applied through door switch 50 to transformer 52, also preferably disposed on the bottom of refrigerator 10 (see FIG. 1). Door switch 50 closes and opens in response to the door 28 closing and opening. Transformer 52 converts the alternating current fed from door switch 50 to AC low-voltage, preferably having a peak or maximum voltage level of less than 24 V that is then applied to circuit breaker 54. Circuit breaker 54 provides an emergency shut-off to limit current flowing out of transformer 52. The low voltage alternating current from circuit breaker 54 is then applied across left standard 20*a*. Electrically connected to left standard 20*a* is bracket 22*a*. Current is then fed to illuminating means 30 in series from standard 20*a*, through bracket 22 and through etch 42*a*. Current is then fed through illuminating means 30 and then back to transformer 52 in series through conductive strip 42*b*, bracket 22, and standard 22*b*. By current flowing through standard 20, shelf 26, and bracket 22 to illuminating means 30, the illuminating means 30 location moves when the shelf 26 is moved.

Figure 6:
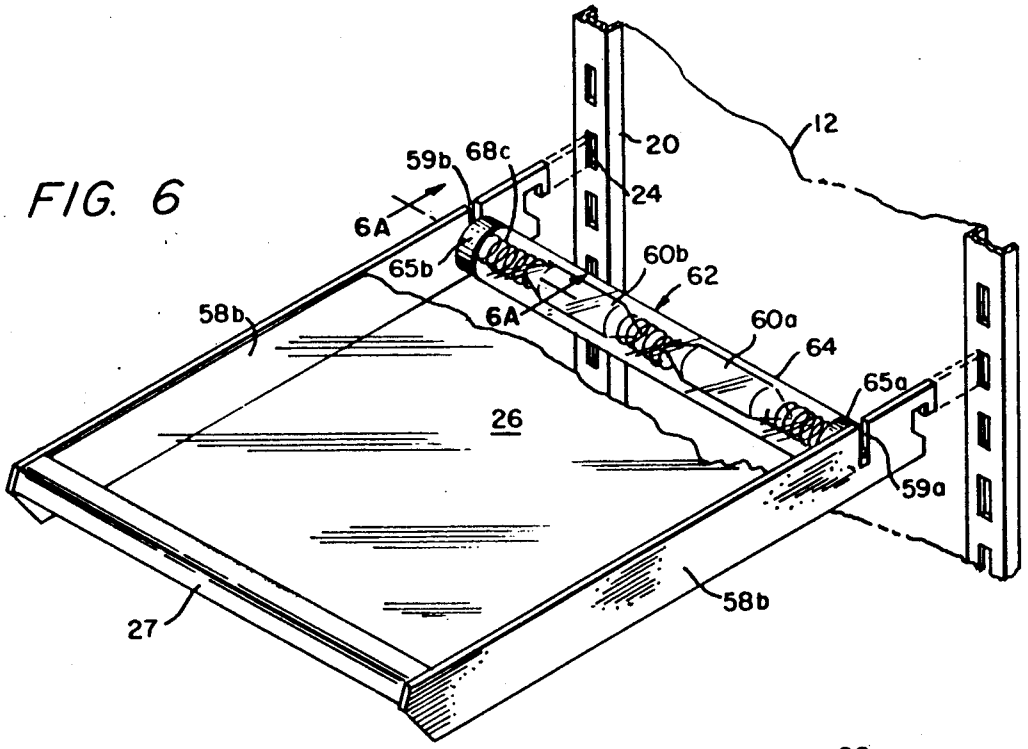
FIG. 6 shows a plan view of an alternate embodiment of the invention having a spring light fixture mounted between two brackets.

Referring to FIG. 6, there is shown an alternate embodiment of the invention having standards 20*a* and 20*b*, brackets 58*a* and 58*b*, supporting shelf 26, and plastic strips 27 and 28 coupled together as explained in FIGS. 1-3. Illuminating means 62 is coupled to slits 59*a* and 59*b* in brackets 58*a* and 58*b*, respectively. Standard 20 and bracket 58 are both constructed with conductive materials that allow current to flow through standard 20 and bracket 58 to illuminating means 62.

Illuminating means 62 includes a transparent tube 64, having lamps 66*a* and 66*b* and springs 68*a*-*c* disposed therein. Referring to FIGS. 6 and 6A, engaging the ends of tube 64 are caps 65*a* and 65*b*. Caps 65*a* and 65 *b* removably engage with slits 59*a* and 59*b*, respectively. Lamps 66*a* and 66*b* and springs 68*a*-*c* are configured within tube 64 such that spring 68*a* electrically contacts cap 65*a* and spring 68*c* electrically contacts caps 65*b*. Coupled between springs 68*a* and 68*c* is lamp 66*a*, spring 68*b*, lamp 66*b*. Lamps 66*a* and 66*b* are shaped in the form of a cone and at each end physically insert into springs 68*a*-*c*. One such lamp is lamp model no. K5017 manufactured by OSRAM Company of Italy.

Figure 6B:
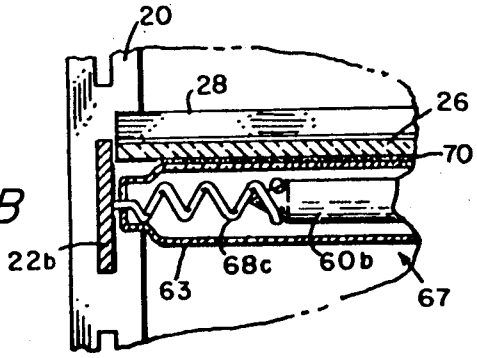
FIG. 6B shows a side view of an alternate embodiment of the light fixture connection shown in FIG. 6A.
Figure 6A:
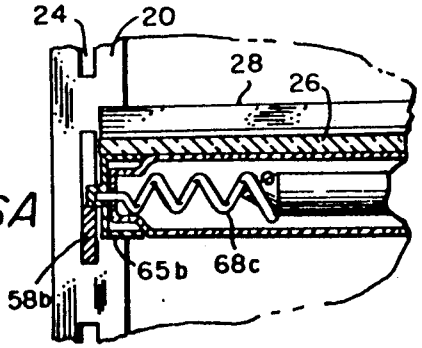
FIG. 6A shows a side view of the light fixture connecting to the bracket cut along lines 6A—6A of FIG. 6.

Referring to FIG. 6B, there is shown an alternate embodiment of illuminating means 62 on the left side of shelf 26, illustrated in FIG. 6A. In this embodiment, there is illustrated a illuminating means 67 that has a tube 63 bonded to shelf 60 with adhesive 70. Within tube 63 is spring 68*c* that removably engages with bracket 22*b* (see also FIGS. 1-3) and lamp 60*b*.

As illuminating means 67 is bonded to shelf 60 and removably engages with bracket 22*b*, when shelf 26 is removed, illuminating means 67 is also removed. Referring to FIGS. 6, 6A, and 6B, it is recognized that illuminating means 62 and 67 may be easily removed from below shelf 26 for replacement of lamps 66*a* and 66*b* by depressing springs 68*a* or 68*c*. It is further recognized that both illuminating means 62 and 67 are electrically coupled below shelf 26 without having to couple wires to shelf 26 to provide power to lamps 66*a* and 66*b*.

Having described the preferred embodiments of this invention, it is now evident that other embodiments incorporating these concepts may be used. It is felt, therefore, that this invention should not be restricted to the disclosed embodiments, but should be limited only by the spirit and scope of the appended claims.

What is claimed is:

1. An apparatus for lighting a compartment comprising:

a shelf disposed within said compartment;

means coupled to said shelf for illuminating the area adjacent said shelf;

means for supporting said shelf in a horizontal position, said supporting means being adapted to adjust the level of said shelf and the level of said illuminating means;

means for providing power to said illuminating means through said supporting means; and wherein said illuminating means comprises a lamp generating light, said lamp being disposed adjacent said shelf; and wherein said shelf has a groove formed within said shelf so as to defract light from said lamp to the area adjacent said shelf.

2. The apparatus as recited in claim 1 wherein said providing means provides power to said illuminating means after said shelf level is adjusted.

3. The apparatus as recited in claim 1 wherein said supporting means further comprises means for conducting current to said illuminating means.

4. The apparatus as recited in claim 1 wherein said power has a maximum voltage level less than or equal to 24 volts.

5. An apparatus for lighting comprising:

a refrigerator having a plurality of vertical walls;

a shelf disposed within said refrigerator;

means coupled to one of said walls for supporting said shelf in a horizontal position, said supporting means being adapted to adjust the vertical level of said shelf;

means coupled to said shelf for illuminating said refrigerator, wherein the vertical level of said illuminating means changes with the shelf vertical level; and wherein said shelf has a surface, wherein said illuminating means radiates light, and wherein said apparatus further comprises a groove disposed within said shelf surface for distributing light from said illuminating means below said shelf.

6. The apparatus as recited in claim 5 further comprising means electrically connected through said supporting means for providing power to said illuminating means.

7. The apparatus as recited in claim 5 wherein said shelf has sides, wherein said supporting means includes a plurality of vertically positioned standards and a plurality of brackets coupled to the sides of said shelf and said standards; and wherein power is distributed to said illuminating means through said standards and said brackets.

8. The apparatus as recited in claim 7 wherein said illuminating means comprises a lamp coupled below said shelf and means coupled to said brackets for distributing power to lamp.

9. The apparatus as recited in claim 8 wherein said power distributing means includes a spring electrically coupling said lamp and said brackets.

10. The apparatus as recited in claim 7 wherein said bracket engages with said standard, and wherein power is distributed to said illuminating means when said brackets engage with said standard.

11. A shelf track lighting device comprising:

a refrigerator having a plurality of walls;

a vertically oriented standard coupled to one of said walls, said standard having a first slit and a second slit disposed therein;

a bracket engaged with said standard through said first slit, said bracket being adapted for removal from said first slit and for engaging with said second slit to change said bracket level;

a first shelf having a bottom surface and being supported by said bracket;

a lamp coupled to said shelf and disposed at a level, said level changing when the level of said bracket changes, said lamp distributing light into and below said shelf; and means for providing power to said lamp through said standard and said bracket, wherein said power providing means comprises an electrically conductive strip coupled to said first shelf for electrically connecting said lamp to said bracket and wherein said refrigerator includes a second horizontally oriented shelf disposed below said first shelf and having a top surface, said first shelf having a groove disposed along the bottom surface of said first shelf to defract the light in said first shelf to the top surface of said second shelf.

12. The device as recited in claim 11 wherein power is provided to said brackets when said brackets engage with said standard.

13. The apparatus as recited in claim 11 wherein said lamp is coupled to the bottom surface of said first shelf.

14. The apparatus as recited in claim 11 further comprising a second vertically oriented standard coupled to one of said walls; a second bracket engaging with said second standard and supporting said first shelf; and means for draining power from said lamp through said second standard and said second bracket.

* * * * *